US006213925B1

(12) United States Patent
Georgitsis et al.

(10) Patent No.: US 6,213,925 B1
(45) Date of Patent: Apr. 10, 2001

(54) METHOD OF AND APPARATUS FOR TRANSFERRING CIGARETTE PACKET BLANKS INTO THE RECEPTACLES OF A CONVEYOR

(75) Inventors: Nikolaos Georgitsis, Lübbecke; Nils Rose, Ahrensburg, both of (DE)

(73) Assignee: Topack Verpackungstechnik GmbH

( * ) Notice: Subject to any disclaimer, the term of this patent is extended or adjusted under 35 U.S.C. 154(b) by 198 days.

(21) Appl. No.: 08/780,744

(22) Filed: Jan. 8, 1997

(30) Foreign Application Priority Data

Jan. 23, 1996 (DE) ..... 196 02 192

(51) Int. Cl.[7] ..... B31B 1/48
(52) U.S. Cl. ..... 493/80
(58) Field of Search ..... 493/168, 167, 493/79, 81, 352, 353, 357, 372, 437, 438, 446

(56) References Cited

U.S. PATENT DOCUMENTS 1,920,761 * 8/1933 Muller .
3,967,543 * 7/1976 Seragnoli ..... 83/152
4,526,562 * 7/1985 Knudsen ..... 493/353
4,559,758 * 12/1985 Gamberini ..... 53/207
5,035,102 * 7/1991 Tomanovits ..... 53/397
5,142,845 * 9/1992 Maclauchlan ..... 53/489
5,146,728 9/1992 Knecht et al. .
5,152,737 * 10/1992 Wu ..... 493/352
5,163,268 11/1992 Vaccari et al. .

FOREIGN PATENT DOCUMENTS 33 47 344 A1 6/1984 (DE) .
39 40 789 A1 6/1991 (DE) .
40 39 133 A1 6/1991 (DE) .
2 132 975 12/1983 (GB) .

* cited by examiner

*Primary Examiner*—Charles T. Jordan
*Assistant Examiner*—Francis T. Palo
(74) *Attorney, Agent, or Firm*—Venable; George Spencer; Robert Kinberg

(57) ABSTRACT

A turntable has an annulus of discrete pockets and is indexible about a vertical axis to position successive pockets at a first station at a level directly above a second station where an intermittently advanced web or strip of coherent blanks is acted upon by cooperating fixed and mobile knives to sever blanks which are thereupon transferred by a pneumatic conveyor along a straight path vertically upwardly into successive pockets of the turntable. The blanks are provided with flaps during transfer from the second station into the respective pockets by moving through a stationary mouthpiece, and the thus deformed blanks can be used as so-called shoulder pieces or understrips in hinged-lid packets for arrays of rod-shaped smokers' products.

20 Claims, 7 Drawing Sheets

METHOD OF AND APPARATUS FOR TRANSFERRING CIGARETTE PACKET BLANKS INTO THE RECEPTACLES OF A CONVEYOR

BACKGROUND OF THE INVENTION

The invention relates to a method of and to an apparatus for manipulating blanks which can form part of packets for cigarettes or other smokers' products. More particularly, the invention relates to improvements in methods of and in apparatus for manipulating blanks which can constitute so-called shoulder pieces or understrips of containers known as hinged-lid packets for plain or filter cigarettes or the like.

As disclosed, for example, in U.S. Pat. No. 3,967,543 to Seragnoli, blanks which are to be converted into the shoulder pieces of hinged-lid packets are separated from the leading end of an intermittently advanced body of coherent blanks, and the freshly separated blanks are introduced into discrete pockets of an indexible turntable for assembly with other constituents of hinged-lid packets. The properly installed shoulder piece of a hinged-lid packet extends somewhat beyond the open end of the main body of the packet and can be concealed by and then releasably engages and holds a lid which is pivotable relative to the rear wall of the main body of the packet.

A drawback of presently known and utilized methods of and apparatus for manipulating shoulder pieces and analogous blanks which are to form part of hinged-lid packets or the like is that successive freshly formed blanks must be advanced along a complex path on their way into the receptacles of a turntable or another conveyor. This increases the likelihood of misalignment, undesirable deformation and/or other adverse influences upon the blanks. Moreover, the transfer of a freshly formed or separated blank into a pocket or another receptacle of a conveyor takes up a relatively long interval of time.

OBJECTS OF THE INVENTION

An object of the invention is to provide a simple, compact and relatively inexpensive but highly reliable apparatus for the manipulation of shoulder pieces or understrips for hinged-lid packets and/or of other types of blanks of paper, cardboard, plastic board material or the like.

Another object of the invention is to provide a novel and improved arrangement for transferring freshly formed blanks from a blank forming (such as separating or severing) station into discrete pockets or other suitable receptacles.

A further object of the invention is to provide an apparatus which is less likely to cause or to permit undesirable deformation and/or misalignment of freshly formed blanks than heretofore known apparatus.

An additional object of the invention is to provide the apparatus with novel and improved simple, compact and efficient means for effecting a desirable and predictable deformation of blanks not later than during introduction into their receptacles.

Still another object of the invention is to provide an apparatus which can be installed in existing (single-track or multiple-track) packing machines for plain or filter cigarettes or other smokers' products as a superior substitute for presently known and utilized blank manipulating apparatus.

A further object of the invention is to provide and novel and improved method of manipulating blanks which are to constitute component parts of packets for smokers' products.

An additional object of the invention is to provide a novel and improved method of manipulating so-called shoulder pieces or understrips prior to incorporation into hinged-lid packets for cigarettes or other smokers' products.

SUMMARY OF THE INVENTION

One feature of the instant invention resides in the provision of a method of introducing blanks (particularly blanks of paper or cardboard which are convertible into component parts of packets, such as hinged-lid packets, for confinement of plain or filter cigarettes or other smokers' products) into discrete pockets or other suitable receptacles of a conveyor. The improved method comprises the steps of advancing discrete receptacles of the conveyor to a first station, separating successive blanks of a series of blanks from a body (e.g., a a web or panel or sheet) of coherent blanks at a second station, and transferring successive separated blanks from the second station along an at least substantially straight path and into discrete receptacles at the first station.

The first and second stations are preferably located at different levels. The positions of the first and second stations are or can be selected in such a way that the aforementioned path is an at least substantially vertical path. Furthermore, the first station is or can be located at a level above the second station.

The method can further comprise the step of deforming selected portions (e.g., two end portions) of each of the successive blanks in the course of the transferring step. Such deforming step can include moving successive blanks through a mouthpiece which surrounds a portion of the path and which is or which can be maintained at a standstill at least during movement of the blanks therethrough.

In accordance with a presently preferred embodiment of the improved method, the first station is disposed at a level above the second station, and the path is at least substantially vertical.

Another feature of the present invention resides in the provision of an apparatus for introducing blanks (e.g., blanks of paper or cardboard which can be converted into so-called shoulder pieces or understrips of hinged-lid packets for arrays of plain or filter cigarettes or other smokers' products) into discrete receptacles of a conveyor which is arranged to advance discrete receptacles to a first station. The improved apparatus comprises means for severing successive blanks of a series of blanks from a web or strip or another suitable body of coherent blanks at a second station, and means for transferring successive severed blanks from the second station into discrete receptacles at the first station along an at least substantially straight path.

The conveyor is preferably indexible about an at least substantially vertical axis, and the aforementioned path can be an at least substantially vertical path.

The means for severing can comprise a substantially horizontal cutting edge and means for moving the cutting edge between two different levels to thus sever a blank from the aforementioned body of coherent blanks.

The apparatus can further comprise means for deforming selected portions of successive severed blanks during transfer of blanks along the aforementioned path, i.e., from the second station to discrete receptacles at the first station. The deforming means can comprise at least one mouthpiece, and such mouthpiece is or can be a stationary mouthpiece. The deforming means is preferably located at a level above the second station.

The means for transferring can comprise means for pneumatically holding succesive blanks during transfer along the aforementioned path, preferably along a vertically upwardly extending path (i.e., the second station is preferably located at a level below the first station).

It is presently preferred to employ transferring means which includes at least one suction conveyor.

The means for severing can include a knife having a supporting surface for successive blanks of the series and at least one recess in the supporting surface. The transferring means of such apparatus can comprise a suction head which is movable between a lower position in the at least one recess to be overlapped by a blank which has been separated from the body of coherent blanks at the second station, and a higher position in which the blank overlapping the suction head is located in the discrete receptacle at the first station.

The body of coherent blanks can include a sheet or the like and the severing means can include cooperating stationary and mobile knives which are located at the second station. The second station is preferably disposed at a level below the first station and the conveyor can include an indexible turntable having an annulus of pockets located in a preferably horizontal plane and each forming part of one of the discrete receptacles.

The novel features which are considered as characteristic of the invention are set forth in particular in the appended claims. The improved apparatus itself, however, both as to its construction and the mode of operating the same, together with numerous additional features and advantages thereof, will be best understood upon perusal of the following detailed description of certain presently preferred specific embodiments with reference to the accompanying drawings.

DESCRIPTION OF PREFERRED EMBODIMENTS

Figure 1:
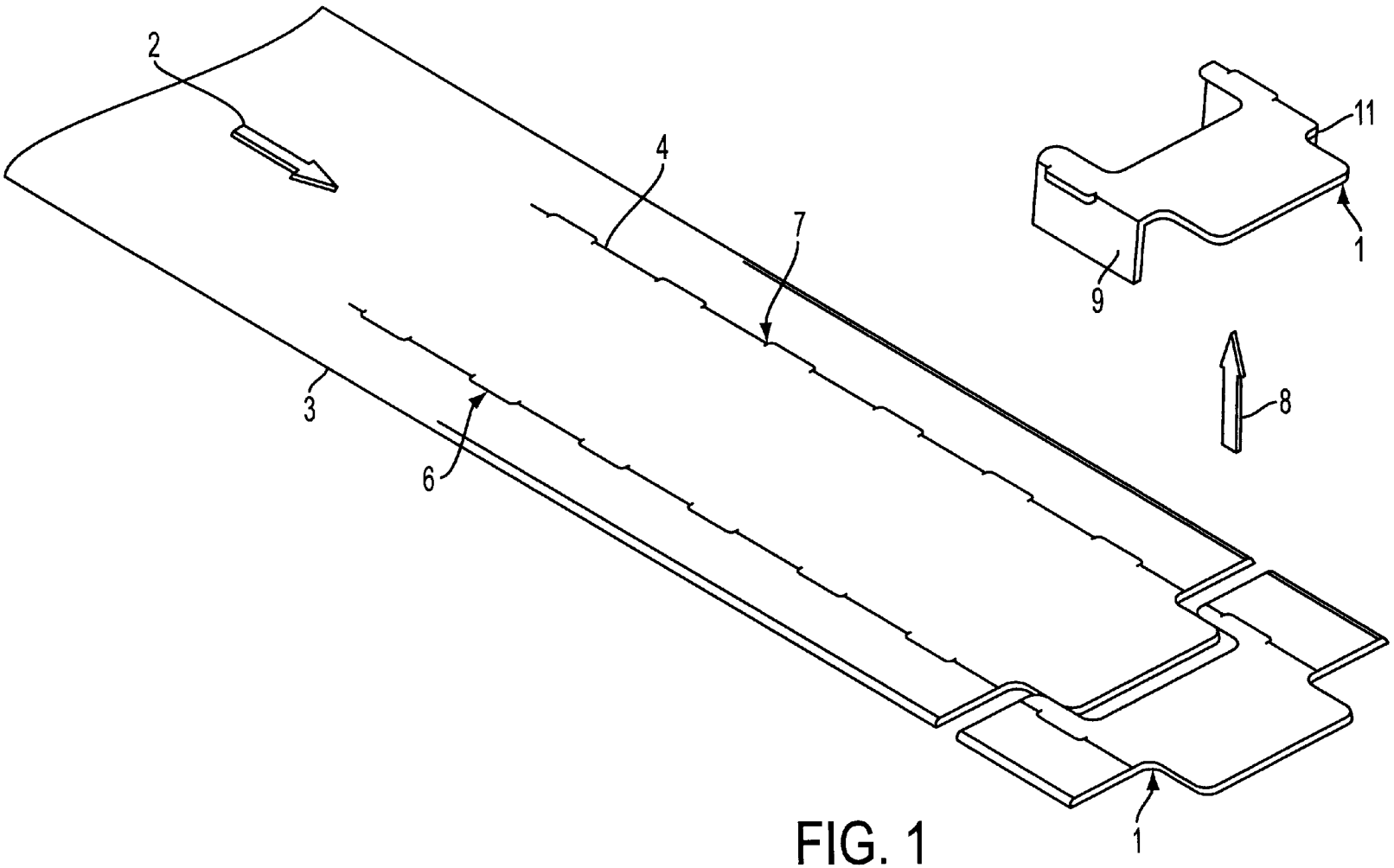
FIG. 1 is a fragmentary perspective view of a web-shaped body of coherent blanks, of a freshly separated blank, and of a second blank which is being transferred toward a receptacle.
Figure 2:
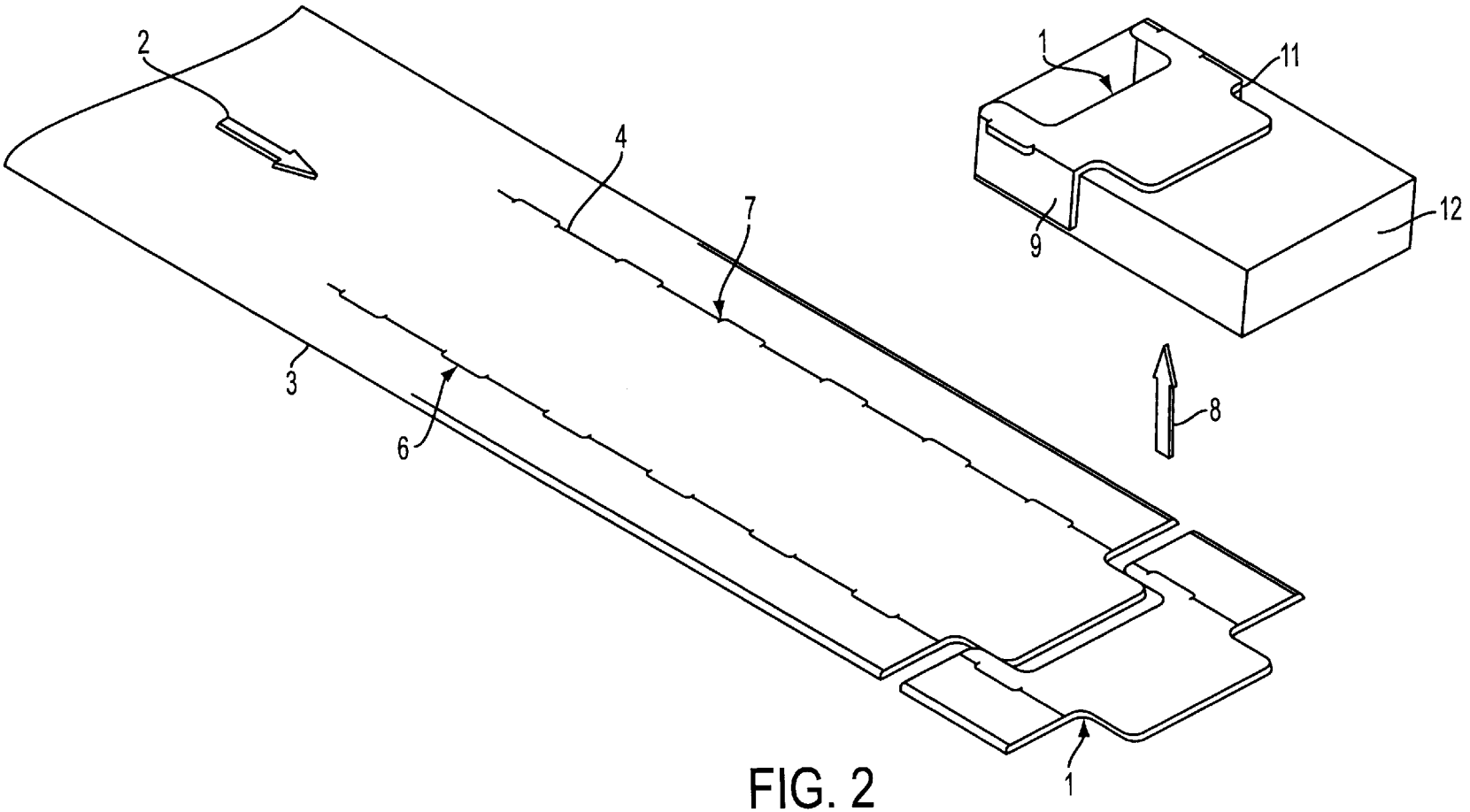
FIG. 2 shows the structure of FIG. 1 but with the second blank located in the interior of a receptacle constituting or including a pocket of an indexible turntable.

Referring to FIG. 1, there is shown a strip- or web-shaped body 3 of coherent blanks 1, and such body (hereinafter called strip or web) is advanced in a stepwise fashion (arrow 2) to a severing or separating station. The illustrated web 3 is provided with two longitudinally extending rows 6, 7 of slits 4 which enable a suitable deforming device (such as the stationary mouthpiece 24 shown in FIGS. 3, 4 and 5) to deform selected portions 9, 11 of successive blanks 1 which have been severed or separated from the leading end of the intermittently advanced web 3. Such deformation takes place during transfer of successively separated blanks 1 along a straight vertical path (see the arrow 8 in FIGS. 1 and 2) into a discrete receptacle 12 of a conveyor (such as a turntable) which is indexible about a vertical axis to advance successive receptacles of an annulus of such receptacles to a station directly above the severing or separating station. The mouthpiece 24 surrounds a portion of the path which is denoted by the arrow 8, i.e., this mouthpiece is located at a level above the web severing or subdividing station and at a level below the station for discrete receptacles 12.

A conveyor for a web of coherent blanks, and a turntable provided with an annulus of equidistant receptacles in the form of pockets are disclosed in the aforementioned U.S. Pat. No. 3,967,543 to Seragnoli. To the extent which might be deemed necessary for a full understanding of the present invention, the disclosure of the patent to Seragnoli is incorporated herein by reference.

The deformed portions 9, 11 are disposed at the longitudinal ends of the respective blanks 1, and such blanks are at least substantially flat during and immediately subsequent to separation from the remainder of the web 3. The latter is (or can be) stationary during separation of a blank 1 from its leading end, and the receptacle (pocket) 12 at the station above the severing station is (or can be) stationary during reception of a freshly severed blank, i.e., of a blank which has been lifted along the straight vertical path denoted by the arrow 8 and has undergone a desired deformation during movement through the stationary mouthpiece 24.

Figure 3:
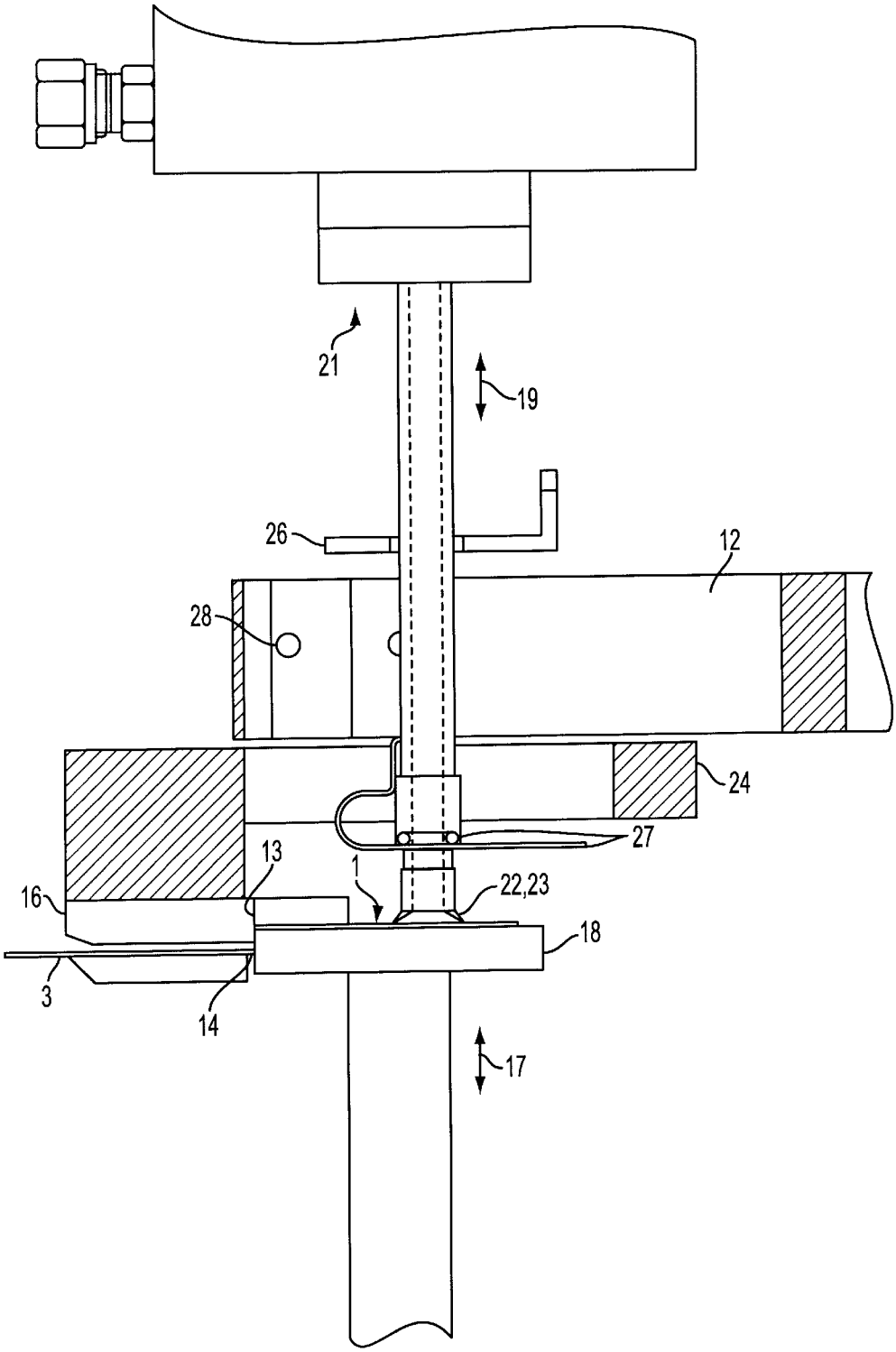
FIG. 3 is a schematic fragmentary vertical sectional view of an apparatus which embodies one form of the invention, a freshly separated blank being shown at a level slightly above the level or plane of the web-shaped body of coherent blanks.

Referring to FIG. 3, the means for separating (severing) successive blanks 1 from the leading end of the intermittently advanced web 3 of coherent blanks comprises a stationary first knife 16 having a substantially horizontal first cutting edge 13, and a vertically reciprocable second knife or counterknife 18 having a substantially horizontal second cutting edge 14 which cooperates with the cutting edge 13 to sever the foremost blank 1 from the leading end of the web 3. The freshly severed or separated blank 1 lies flush on the horizontal upper side or surface of the vertically reciprocable knife 18. The double-headed arrow 17 indicates the directions of vertical reciprocatory movement of the knife 18; such movement can be effected, for example, by the piston rod (shown but not referenced) of a suitable hydraulic or pneumatic cylinder and piston unit whose operation is properly synchronized with that of the conveyor for the intermittently advanced web 3 and with that of the turntable including the receptacles (pockets) 12.

Figure 4:
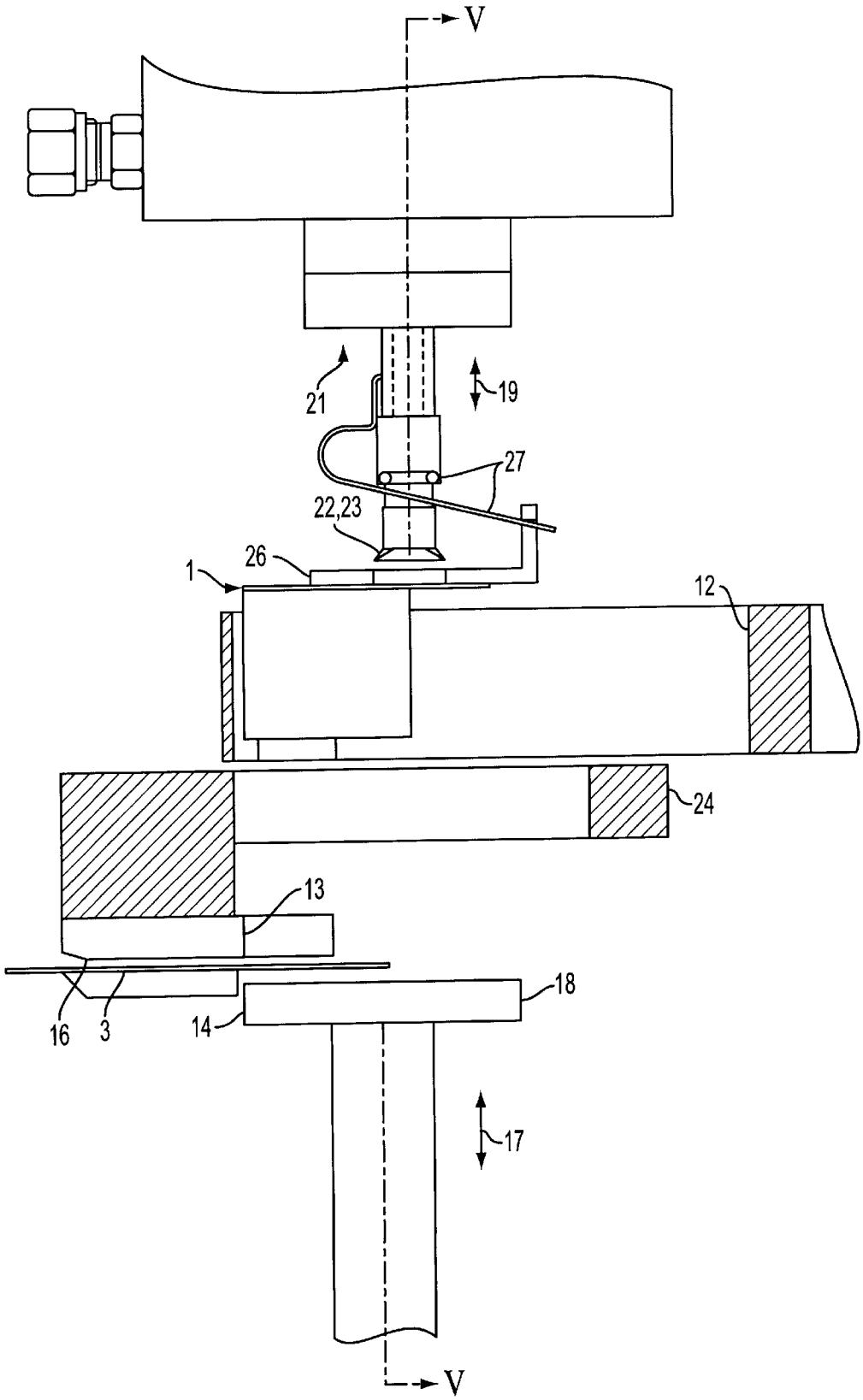
FIG. 4 shows the structure of FIG. 3 but with the freshly separated and already deformed blank in the receptacle of the turntable.
Figure 5:
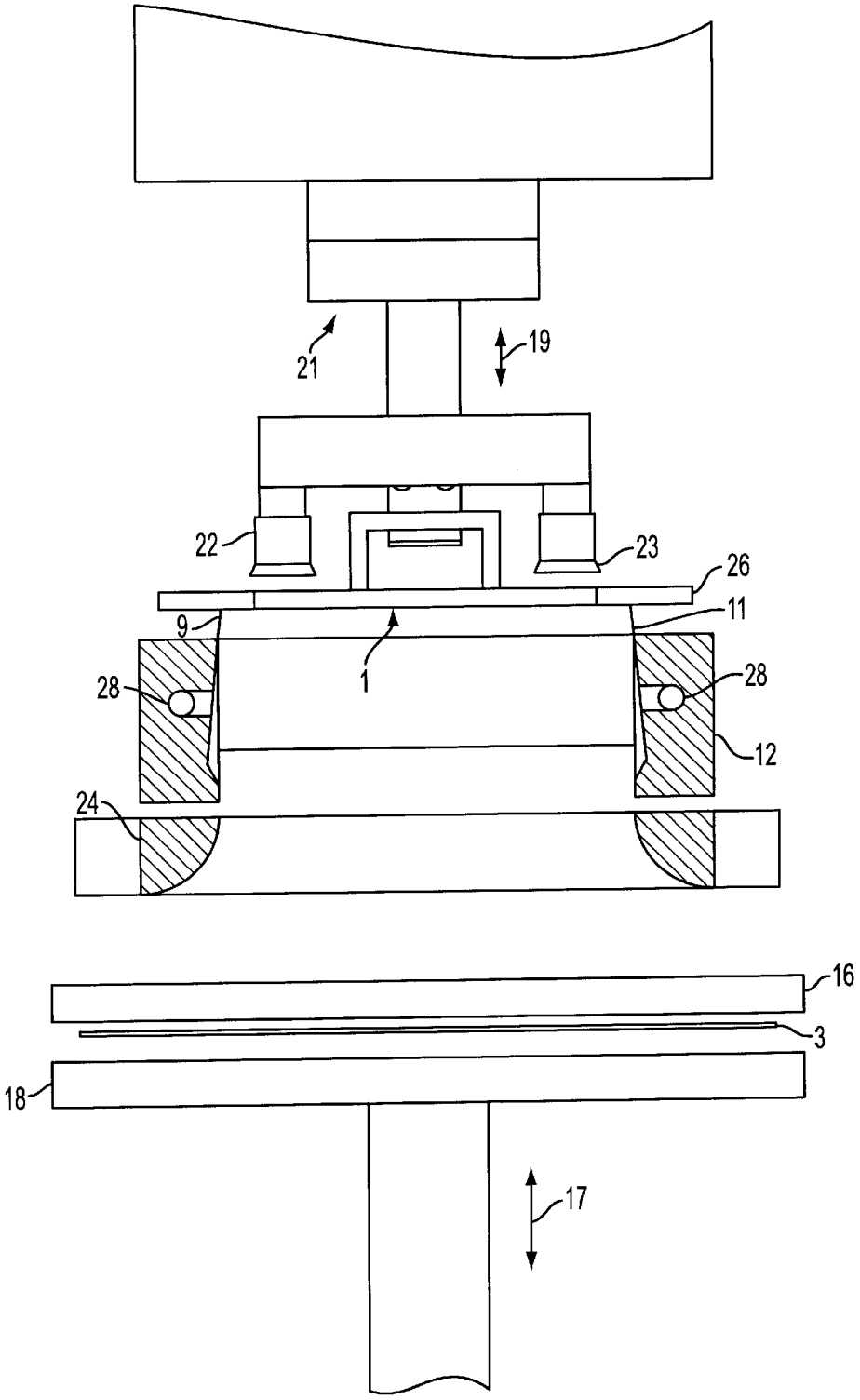
FIG. 5 is a sectional view substantially as seen in the direction of arrows from the line V—V in FIG. 4.

The means for transferring freshly separated blanks 1 from the station for the knives 16, 18 to the station for discrete receptacles 12 comprises a pneumatic conveyor 21 which includes a suction head including two suction cups 22, 23 and being movable up and down in directions indicated by a double-headed arrow 19. The means for moving the suction cups 22, 23 through the receptacle 12 which registers with the severing or separating station and through the stationary mouthpiece 24 to attract a freshly separated blank 1 overlying the upper side or surface of the reciprocable knife 18 can comprise a suitable fluid-operated motor (shown but not referenced). Suction which is applied by the cups 22, 23 against the upper side of the blank 1 which shares the upward movements of such cups is sufficiently pronounced to ensure that the end portions or flaps 9, 11 are bent at angles of at least close to 90° relative to the central main portion of the upwardly moving blank during transport through the stationary mouthpiece 24. As can be seen in FIGS. 3, 4 and 5, the mouthpiece 24 can be installed at a level immediately beneath the receptacle 12 which is about to receive the ascending freshly deformed blank 1.

The conveyor 21 is or can be designed in such a way that a blank 1 which has been lifted off the knife 18 is advanced in the direction of the arrow 8 without interruptions, through the mouthpiece 24 and all the way into the awaiting receptacle 12. A stationary stop 26 is provided to arrest the fully lifted (freshly deformed) blank 1 in an optimum position with reference to the respective receptacle 12, i.e., to separate such blank from the suction cups 22, 23 of the suction head forming part of the conveyor 21. The conveyor 21 further comprises a suitable pneumatic valve 27 having a resilient valving element which is actuated by the stop 26 upon completion of the upward movement of a blank 1 so as to disconnect the suction cups 22, 23 from a suction generating device (not shown) in good time to reduce the likelihood of unsatisfactory positioning (orientation and/or level) of the freshly lifted blank 1 relative to the respective receptacle 12 of the indexible turntable.

The receptacles 12 can be provided with suction ports 28 which are connected to the aforementioned suction generating device, or to another suction generating device, not later than upon completed lifting of a blank 1 into the awaiting receptacle. The manner in which a blank 1 which has entered the registering receptacle 12 is thereupon assembled with the remaining part or parts (e.g., one or more coupons, a substantially box-shaped blank, and one or more envelopes) of a hinged-lid packet for plain or filter cigarettes or other smokers' products forms no part of the present invention. The suction ports 28 can attract the adjacent deformed (bent) end portions or flaps 9, 11 of the blank 1 in the respective receptacle 12.

As can be seen in FIGS. 4 and 5, the upper portion of the blank 1 which has entered the respective receptacle 12 and abuts the stop 26 extends upwardly beyond the receptacle. The arrow 8 denotes (in FIGS. 1 and 2) the presently preferred (shortest) vertical path for the transfer of successive blanks 1 from the severing or separating station to the station for successive discrete receptacles 12.

An important advantage of the improved method and apparatus is their simplicity. Furthermore, the transfer of successive freshly separated blanks 1 can be completed within short intervals of time, in a small area, and in such a way that a misalignment of blanks during transfer into their receptacles is much less likely to occur than in heretofore known apparatus. The output of the improved blank forming, deforming and transferring apparatus can greatly exceed the output of conventional apparatus without risking a misalignment of the blanks and/or other undesirable treatments which could affect the appearance and/or other desirable characteristics of the hinged-lid packets.

The mouthpiece 24 (or another suitable blank shaping or deforming device) constitutes an optional but highly desirable and advantageous feature of the improved apparatus. Thus, each blank is automatically deformed to a desired extent during its preferably straight-line transfer from the lower station (for the knives 16, 18) to the upper station (for discrete receptacles 12). The deforming action of the mouthpiece 24 is such that each freshly deformed blank 1 can readily enter the respective receptacle 12 and that its deformed portions or flaps 9, 11 are brought to a halt adjacent to and are attracted by the suction ports 28 of such receptacle.

It has been found that the improved method can be practiced, and that the improved apparatus can be utilized, in packing machines which are designed to turn out single rows or multiple (e.g., twin) rows of hinged-lid packets for arrays of plain or filter cigarettes or other smokers' products.

Figure 6:
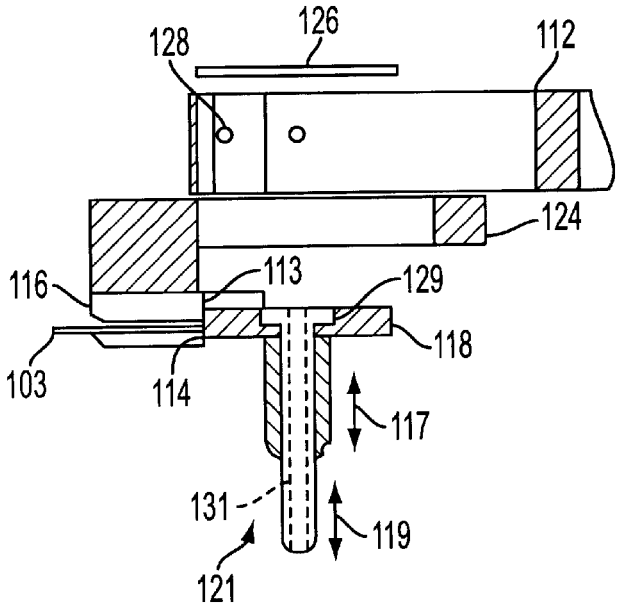
FIG. 6 is a fragmentary vertical sectional view of a modified apparatus with a blank shown at a level slightly above the plane of the web-shaped body of coherent blanks.
Figure 7:
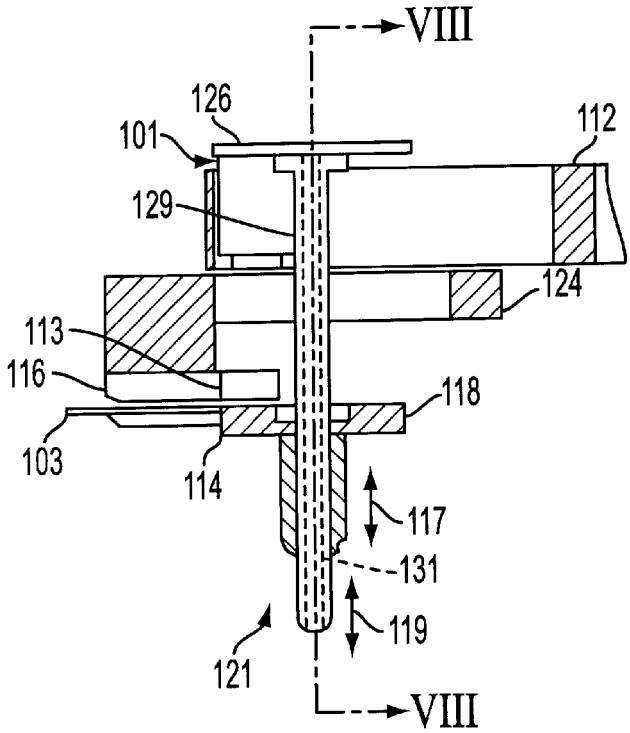
FIG. 7 illustrates the structure of FIG. 6 but with the freshly separated and already deformed blank in the interior of a receptacle.
Figure 8:
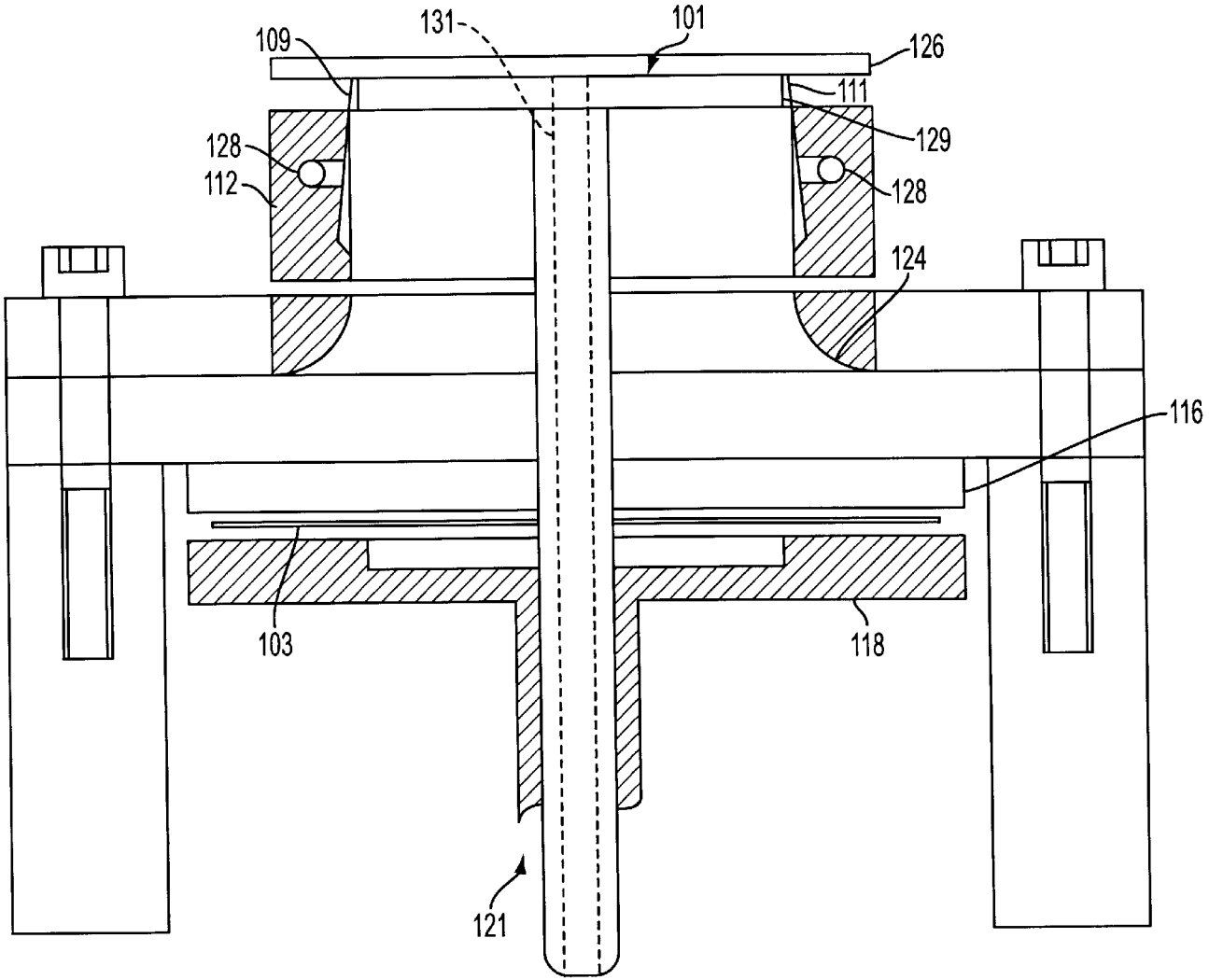
FIG. 8 is an enlarged view as seen in the direction of arrows from the line VIII—VIII in FIG. 7.

FIGS. 6, 7 and 8 illustrate a portion of an apparatus which constitutes one presently preferred modification of the apparatus shown in FIGS. 3 to 5. All such parts of the modified apparatus which are identical with or plainly analogous to the corresponding parts of the apparatus shown in FIGS. 3 to 5 are denoted by similar reference characters plus 100.

A first difference between the two illustrated apparatus is that the upper side or surface of the vertically reciprocable knife or counterknife 118 is provided with a recess for the suction head 129 at the upper end of a fluid-operated conveyor 121 serving as a means for transferring successive freshly separated blanks 101 from the severing or separating station into the aligned receptacle 112 at the station directly above the knives 116, 118. The vertically reciprocable support of the conveyor 121 for the suction head 129 is provided with a suction channel 131 which connects the suction head 129 with a suction generating device (not shown) not later than when a blank 101 at the leading end of the web 103 reaches and overlies the upper side or surface of the reciprocable knife 118. The suction head 129 is lifted out of its recess in the knife 118 and raises the freshly separated blank 101 through the deforming means (mouthpiece) 124 and into the registering receptacle 112 wherein the freshly deformed blank 101 is attracted by suction ports 128 while abutting the stop 126. The suction head 129 is thereupon lowered back into the recess in the upper side of the knife 118 which latter is also lowered from the upper or raised position to its second or lower position before the web 103 is again advanced by a step to position the (still non-separated) blank 101 at its leading end on the upper side of the knife 118.

An advantage of the apparatus of FIGS. 6 to 8 is that the leading end of the web 103 can be attracted by the suction head 129 from below (i.e., against the flat upper side or surface of the knife 118) even before a separating or severing step begins. This even further reduces the likelihood of misalignment of a freshly severed or separated blank 101 relative to the respective receptacle 112. At least the major part of the conveyor 121 is installed at a level below the knives 116, 118.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making and processing blanks for hinged-lid packets for cigarettes and the like and, therefore, such adaptations should and are intended to be comprehended within the meaning and range of equivalence of the appended claims.

What is claimed is:

1. A method of introducing blanks—which are convertible into component parts of packets for smokers' products—into discrete receptacles of a conveyor, comprising the steps of advancing discrete receptacles of the conveyor to a first station; separating successive blanks of a series of blanks from a body of coherent blanks at a second station; and transferring successive separated blanks from said second station, along an at least substantially straight path, and into discrete receptacles at said first station, wherein said stations are located at different levels.

2. The method of claim 1, wherein said path is an at least substantially vertical path.

3. The method of claim 1, wherein said advancing step includes indexing the conveyor about an at least substantially vertical axis.

4. The method of claim 1, further comprising the step of deforming selected portions of successive blanks in the course of said transferring step.

5. The method of claim 4, wherein said deforming step includes moving successive blanks through a mouthpiece.

6. The method of claim 5, further comprising the step of maintaining the mouthpiece at a standstill during movement of successive blanks therethrough.

7. The method of claim 1, wherein said first station is disposed at a level above said second station and said path is an at least substantially vertical path.

8. Apparatus for introducing blanks—which are convertible into component parts of packets for smokers' products—into discrete receptacles of a conveyor which is arranged to advance discrete receptacles to a first station, comprising means for severing successive blanks of a series of blanks from a body of coherent blanks at a second station; and means for transferring successive severed blanks from said second station into discrete receptacles at said first station along an at least substantially straight path, wherein said conveyor is indexible about an at least substantially vertical axis and said path is an at least substantially vertical path.

9. The apparatus of claim 8, wherein said means for severing comprises a substantially horizontal cutting edge and means for moving said cutting edge between two different levels to thus sever a blank from said body of coherent blanks.

10. The apparatus of claim 8, further comprising means for deforming selected portions of successive severed blanks during transfer of blanks along said path.

11. Apparatus for introducing blanks—which are convertible into component parts of packets for smokers' products—into discrete receptacles of a conveyor which is arranged to advance discrete receptacles to a first station, comprising means for severing successive blanks of a series of blanks from a body of coherent blanks at a second station; and means for transferring successive severed blanks from said second station into discrete receptacles at said first station along an at least substantially straight path, and further comprising means for deforming selected portions of successive severed blanks during transfer of blanks along said path, wherein said deforming means comprises at least one mouthpiece.

12. Apparatus for introducing blanks—which are convertible into component parts of packets for smokers' products—into discrete receptacles of a conveyor which is arranged to advance discrete receptacles to a first station, comprising means for severing successive blanks of a series of blanks from a body of coherent blanks at a second station; and means for transferring successive severed blanks from said second station into discrete receptacles at said first station along an at least substantially straight path, and further comprising means for deforming selected portions of successive severed blanks during transfer of blanks along said path, wherein said deforming means is stationary.

13. The apparatus of claim 10, wherein said deforming means is located at a level above said second station.

14. The apparatus of claim 13, wherein said means for transferring comprises means for pneumatically holding successive blanks during transfer along said path.

15. The apparatus of claim 8, wherein said first station is located at a level above said second station.

16. The apparatus of claim 8, wherein said means for transferring includes a suction conveyor.

17. The apparatus of claim 8, wherein said means for severing includes a knife having a supporting surface for successive blanks of said series and a recess in said surface, said means for transferring including a suction head which is movable between a lower position in said recess to be overlapped by a blank which has been separated from the body of coherent blanks and a higher position in which the overlapping blank is located in the discrete receptacle at said first station.

18. The apparatus of claim 8, wherein said body is a sheet and said severing means includes cooperating stationary and mobile knives located at said second station, said second station being disposed at a level below said first station and said conveyor including an indexible turntable having an annulus of pockets each forming part of one of said discrete receptacles.

19. A method of introducing blanks—which are convertible into component parts of packets for smokers' products—into discrete receptacles of a conveyor comprising the steps of advancing discrete receptacles of the conveyor to a first station located at a first level, said advancing step including indexing the conveyor about an at least substantially vertical axis; separating successive blanks of a series of blanks from a body of coherent blanks at a second station located at a second level below said first level; transferring successive separated blanks from said second station, along an at least substantially straight and at least substantially vertical path, and into discrete receptacles at said first station; deforming selected portions of successive blanks in the course of said transferring step, including moving successive blanks through a mouthpiece; and maintaining the mouthpiece at a standstill during movement of successive blanks therethrough.

20. Apparatus for introducing blanks—which are convertible into component parts of packets for smokers' products—into discrete receptacles of a conveyor which is indexible about an at least substantially vertical axis and is arranged to advance discrete receptacles to a first station located at a first level, comprising means for severing successive blanks of a series of blanks from a sheet of coherent blanks at a second station located at a second level below said first level; means for transferring successive severed blanks from said second station into discrete receptacles at said first station along an at least substantially straight and at least substantially vertical path, including a suction conveyor for pneumatically holding successive blanks during transfer along said path; and stationary means for deforming selected portions of successive severed blanks during transfer of blanks along said path, said deforming means comprising at least one mouthpiece and being located at a level above said second station.

* * * * *